US008136173B2

(12) United States Patent
Knox et al.

(10) Patent No.: US 8,136,173 B2
(45) Date of Patent: Mar. 20, 2012

(54) SINK DRAIN TREATMENT KIT

(75) Inventors: Gettys Haywood Knox, Union, SC (US); Robert James Sandee, Oak Ridge, NC (US)

(73) Assignee: American Technical Solutions, Inc, Walker town, NC (US)

( * ) Notice: Subject to any disclaimer, the term of this patent is extended or adjusted under 35 U.S.C. 154(b) by 1527 days.

(21) Appl. No.: 11/588,998

(22) Filed: Oct. 27, 2006

(65) Prior Publication Data

US 2008/0098504 A1 May 1, 2008

(51) Int. Cl.
*E03D 9/00* (2006.01)
*A47K 1/14* (2006.01)
*E03C 1/26* (2006.01)

(52) U.S. Cl. ..... 4/287; 4/255.08

(58) Field of Classification Search ..... 4/286, 287, 4/290, 292, 295, 255.04, 255.07–255.09
See application file for complete search history.

(56) References Cited

U.S. PATENT DOCUMENTS

| | | | | |
|---|---|---|---|---|
| 506,872 | A | 10/1893 | Chase | |
| 655,888 | A | 8/1900 | O'Neil | |
| 964,954 | A | 7/1910 | Coles | |
| 994,442 | A | 6/1911 | Coles | |
| 1,058,277 | A | 4/1913 | Tucker | |
| 1,658,645 | A | 2/1928 | McGee | |
| 1,894,711 | A | 1/1933 | Schacht | |
| 3,064,275 | A | 11/1962 | Allen | |
| 3,537,113 | A | 11/1970 | Elzner | |
| 3,605,135 | A | 9/1971 | Tan | |
| 3,727,763 | A * | 4/1973 | Arenskov | 4/287 |
| 3,770,204 | A | 11/1973 | Schuster | |
| 3,982,289 | A * | 9/1976 | Robbins | 4/292 |
| 4,756,480 | A | 7/1988 | Fish | |
| 4,768,237 | A | 9/1988 | Torti | |
| 5,787,516 | A | 8/1998 | Davenport | |
| 6,019,537 | A | 2/2000 | Hunt | |
| 6,163,895 | A | 12/2000 | Davenport | |
| 6,295,659 | B1 | 10/2001 | Sandness | |
| 6,345,410 | B1 | 2/2002 | Baker | |
| 6,934,975 | B2 | 8/2005 | Knox et al. | |
| 7,458,108 | B2 * | 12/2008 | Wolf | 4/290 |

* cited by examiner

*Primary Examiner* — Tuan Nguyen
(74) *Attorney, Agent, or Firm* — Robert W. Pitts

(57) ABSTRACT

A kit for use in treating a sink drain so that drain remains both open and clean includes an unclogging device and a strainer, which though packagable or stackable together would normally be used separately. The unclogging device can be used to concentrate the spray from a nozzle to assist in unclogging a drain. The strainer would normally reside in a sink drain to prevent debris from clogging or restricting the drain. One version of the strainer provides space for an air freshener that can be replaced. These kits also include a sealing stopper and a gasket.

13 Claims, 8 Drawing Sheets

SINK DRAIN TREATMENT KIT

BACKGROUND OF THE INVENTION

1. Field of the Invention

This invention relates to a kit or cluster package of components suitable for use in unclogging sink drains and disposal units, preventing clogs in the first place and positioning an air freshener at the drain entrance to mask or attack odors emanating from the drain.

2. Description of the Prior Art

Clearing clogged or slow drains resulting from food and/or other particle build-up remains a time consuming and cumbersome task, notwithstanding the advent of modern conveniences. Even with the widespread availability of various plunger devices and chemical solvents that are designed to clear drains, clearing drains remains a time-consuming task and a frustrating experience.

Food particles and other foreign matter may often be released into the drain during the process of cleaning dishes and other objects in a sink. These food particles and other foreign matter may accumulate in the drains and result in a partially or completely clogged drain. Commonly, the kitchen sink is provided with a manually operable hose spray. Such sprays are normally stowed adjacent to the faucet and are connected to the faucet water supply by an extendable flexible hose. The hand spray may be manipulated to deliver a spray to the clogged drain. However, not all food particles and/or foreign matter can be cleared from the drain by the hand spray and resort must be made to other devices for removing more resistant deposits, blockages, and the like.

Preventive measures will reduce the occurrence of clogged drains. Strainers of various forms are common devices placed in drains to prevent debris from ever entering a drain.

Another prior art approach is to place an air freshener in a drain or in a holder positioned in the drain. An example is found in U.S. Pat. No. 6,866,440 in which a consumable air freshener is encapsulated into a garbage disposal drain stopper. U.S. Pat. No. 7,032,253 discloses a screw on plug that engages a straining basket and mentions the possibility of incorporating an antibacterial and/or deodorizer additive into the basket or plug. None of this prior art, however, considers the possibility of a kit that would package or cluster an unclogging device with a strainer, a stopper for a sink drain and an air freshener device that could be employed therewith.

SUMMARY OF THE INVENTION

A kit for treating a sink includes an outer unclogging member, a strainer, and a stopper. The outer member includes a central projection that can enagage a spray nozzle for clearing a clogged drain. The strainer can be packaged within the outer unclogging member. The strainer cap can be removed from the outer member. The strainer has a perforated base and a hollow central column. The central projection on the unclogging device is received within the hollow central column when the strainer is packaged within the outer member. A stopper is packaged on top of the strainer. A basic strainer used only to prevent debris from entering a sink drain can be a molded one-piece member. Another strainer including a chemical cartridge, such as an air freshener, can employ a strainer cap screwed or otherwise attached to a hollow central column to house an air freshening member.

Alternatively the invention comprises a drain treatment cluster. Clustered components include a plurality of stackable components separately useable to maintain a sink drain in a flowing condition. The cluster includes a cylindrical outer member, a cylindrical strainer, and a stopper. The cylindrical outer member being is used to unclog a stopped drain and includes a central projection having a tapered inner surface extending upward from surrounding solid base. The tapered inner surface engages a spray nozzle to concentrate injection of water from the spray nozzle into a stopped drain. The cylindrical has an annular base with a hollow central column extending upwardly therefrom. A top section of the hollow central column and the annular base each have a plurality of perforations for straining debris before it enters a sink drain when the cylindrical strainer is positioned in or over a sink drain. The stopper can be placed over a drain to cover and seal the drain. Different strainers are employed with or without and air freshener.

Either type of strainer includes a perforated base, a hollow central column and an outer wall. The hollow central column extends upwardly from the strainer base. The hollow central column is enclosed by a perforated top section, which can be an integral part or can comprise a strainer cap. A wall extends upwardly from a peripheral edge of the perforated base. The wall is spaced radially outward from the hollow central column to form a toroidal space between the wall and the hollow central column. The top section of the hollow central column is elevated relative to the perforated base. These strainers include a peripheral lip extending radially outward from a top edge of the wall. The strainer is insertable into a drain having a diameter at least equal to the outer diameter of the wall but less than the outer diameter of the peripheral lip. The perforated base and the perforated top sections of the hollow central column permit passage of fluids, but obstruct passage of solid objects that are larger than perforations in the hollow central section and in the base.

BRIEF DESCRIPTION OF THE DRAWINGS

FIG. 3A is a top view of the outer unclogging device. FIG. 3B is a side view, and FIG. 3C is a section view taken along section lines 3C-3C shown in FIG. 3A.

FIG. 4A is a top view and FIG. 4B is a side view. FIG. 4C is a section view taken along section lines 4C-4C in FIG. 4A.

FIGS. 5A-5D 5D are views of a stopper of the type suitable for use with the kits shown in FIGS. 1 and 2. FIG. 5A is a top view, and FIG. 5B is a side view. FIG. 5C is a section view taken sections lines 5C-5C in FIG. 5A. FIG. 5D shows the manner in which an emblem or logo can be inserted into the stopper.

FIG. 6A is a top view. FIG. 6B is a side view. FIG. 6C is a sectional view taken along section lines 6C-6C in FIG. 6A.

FIG. 7A shows the top view of the strainer. FIG. 7B is an exploded side view of the strainer and an air freshening cartridge and strainer cap exploded from the main body of the strainer cap. FIG. 7C is a section view from the perspective of section lines 7C-7C in FIG. 7A, but also showing the air freshener cartridge and the strainer cap exploded from the strainer base. FIG. 7D is an exploded three dimensional view showing the components of the air freshening strainer.

DETAILED DESCRIPTION OF THE PREFERRED EMBODIMENTS

Figure 1:
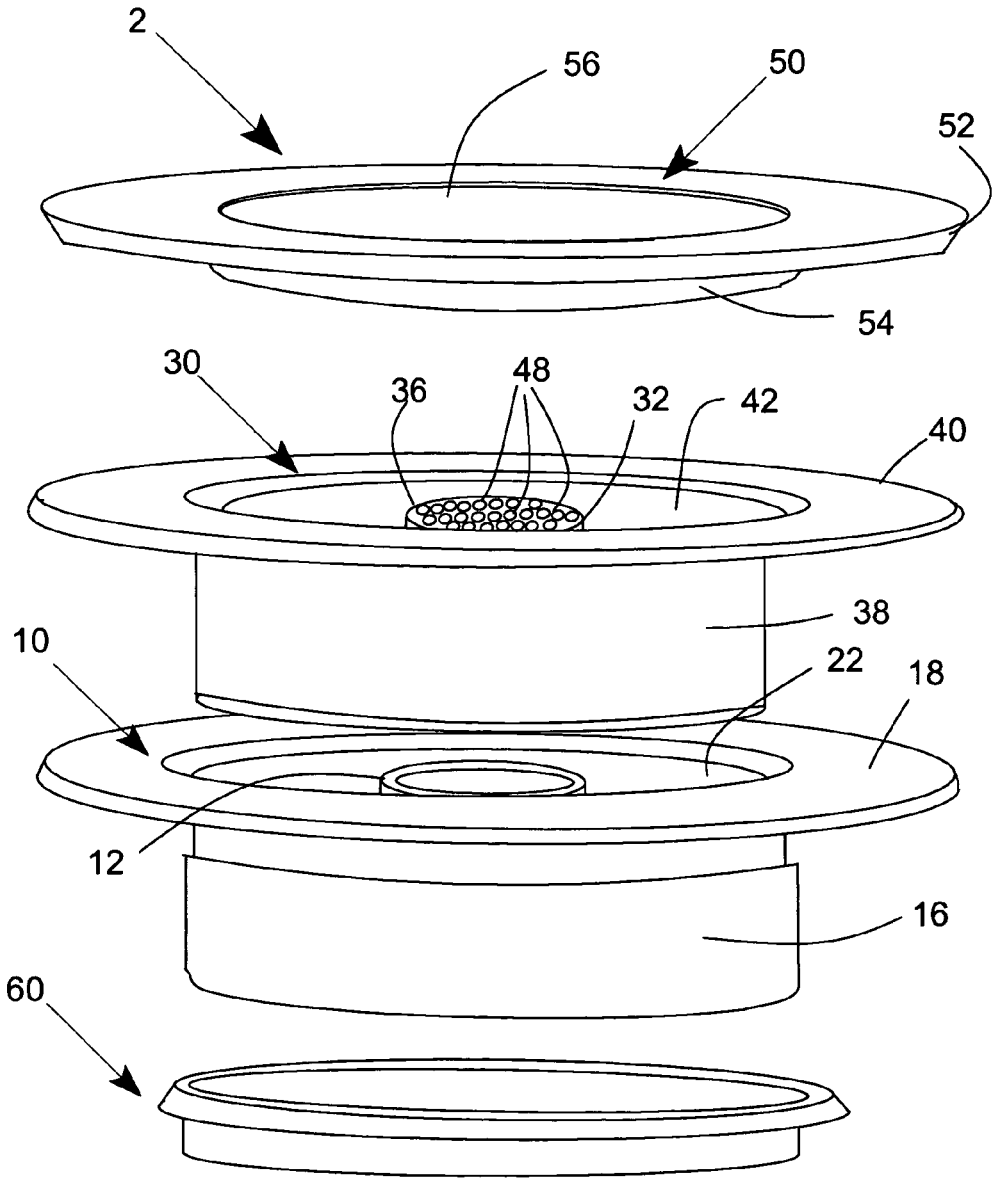
FIG. 1 is an exploded view showing the main components of a basic sink drain treatment kit.
Figure 2:
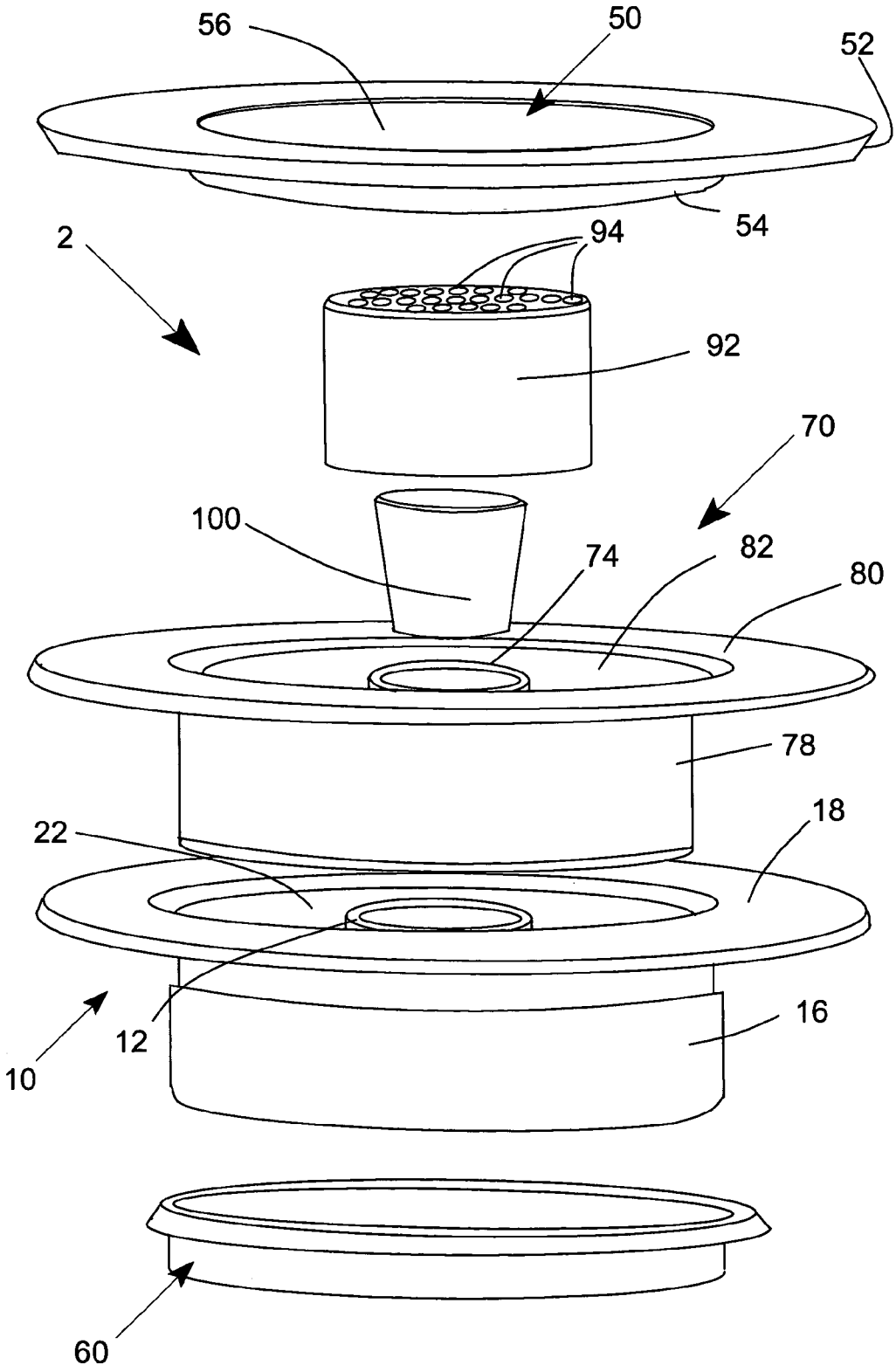
FIG. 2 is an exploded view showing the main components of an alternative sink drain treatment kit that includesan air freshener.

FIGS. 1 and 2 show two alternate versions of a kit 2 or cluster of components that can be employed to help maintain a sink drain, and especially a kitchen sink drain in a clean free flowing state. Each version of the kit 2 includes a plurality of stackable components that can be packaged or stored in a relatively small space. Combination of these components in a relatively small package is significant, because shelf space or space on a pegboard in a retail facility is always limited, especially space in higher traffic areas. Storage in a small space with the components clustered together is also significant both because space in kitchen or other place containing a sink is also generally at a premium and the ability to stack the components in a cluster makes it easier to find the individual components when they are needed.

FIG. 1 shows a version of kit 2 including an unclogging device 10, a strainer 30 and a stopper 50, which also functions as a drain cover or seal. The unclogging device 10 forms the outer member of a stack of these components. Both the unclogging device 10 and the strainer 30 have outer walls 16 and 38 respectively in the form of right circular cylinders of a diameter on the same order of magnitude as the inner diameter of a standard sink drain, so that both can normally fit within the sink drain. The strainer 30 can be stacked within the cylindrical outer wall 16 of the unclogging device 10 because the strainer outer wall 38 has an outer diameter that is less than the inner diameter of the outer device wall 16. An outer peripheral lip 40 on the strainer 30 will fit over the outer peripheral lip 18 on the outer unclogging device 10 when the strainer 30 is stacked or packaged within the outer member 10. Peripheral lips 18 and 40 will prevent the unclogging device 10 and the strainer 30 from falling into an oversized drain. Lips 18 and 40 also facilitate sealing off the drain opening or the disposal to create a closed loop system and prevent water from splashing out. The unclogging device 10 includes a generally cylindrical central projection 12, which serves as a support for a standard spray nozzle when the device is used to unclog a sink drain. A central column 32 on the strainer, also having a generally cylindrical configuration, is dimensioned to fit over the central projection 12 when the strainer 30 is stacked on top of or nested with the outer unclogging device 10.

A generally round stopper 50 forms the top part of the stack of components forming the kit shown in FIG. 1. This stopper 50 can be used to cover a sink drain. Stopper 50 is formed of a more flexible or rubbery material than the unclogging device 10 or the strainer 30 so that the stopper will form a seal when placed over a sink drain.

The fourth component of kit 2 as shown in FIG. 1 is a gasket 60 that fits around the exterior of outer unclogging member 10. This gasket 60 allows the unclogging member 10 to be used with sink drains having different inner diameters.

FIG. 2 shows a second version of a kit 2, which has all of the same components as the kit shown in FIG. 1, but also includes an air freshening cartridge 100. The addition of a freshening cartridge 100 has, however, resulted in configuration changes to the basic strainer. Strainer 70 includes means for storing the freshening cartridge 100, and has replaced strainer 30 in the embodiment of FIG. 2. In strainer 30, the central column 32 includes a top section 36 that is integral with the column cylindrical wall 34. In strainer 70, the central column 72 comprises a strainer cap 92, which can be attached to and detached from cylindrical column wall 74. The freshening cartridge can be inserted into the space within column wall 74 and strainer cap 92 can then be attached entrapping the freshening cartridge 100. Perforations 94 in the strainer cap 92 allow water to flow over and/or through the freshening cartridge when the strainer 70 is positioned within a sink drain. The unclogging device 10, stopper 50 and gasket 60 in the kit embodiment of FIG. 2 can be identical to the corresponding components in the embodiment of FIG. 1.

Figure 3B:
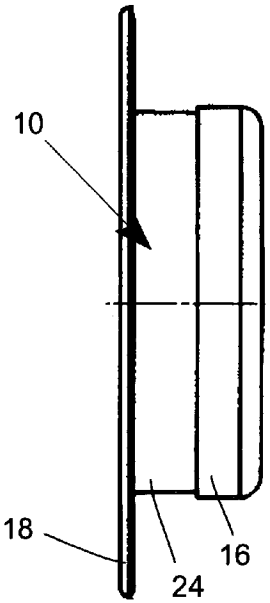
FIGS. 3A-3C show an outer unclogging device suitable for use in either of the sink drain treatment kits shown in FIGS. 1 and 2.
Figure 3A:
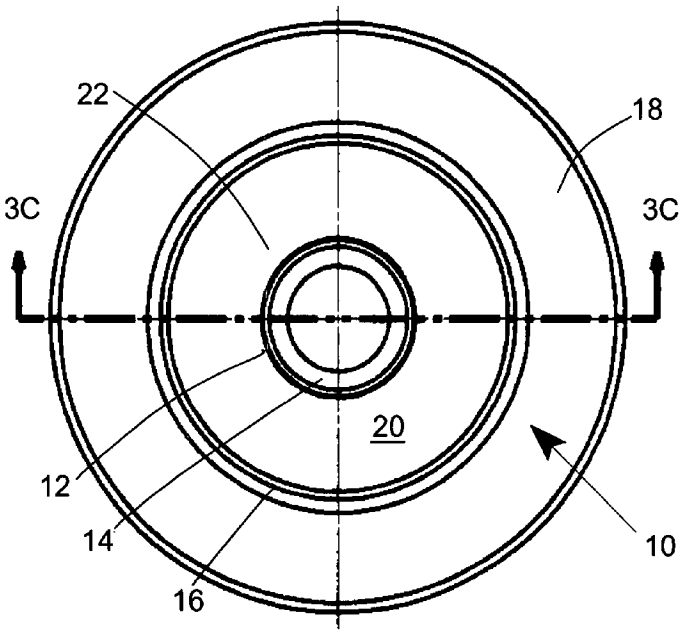
Figure 3C:
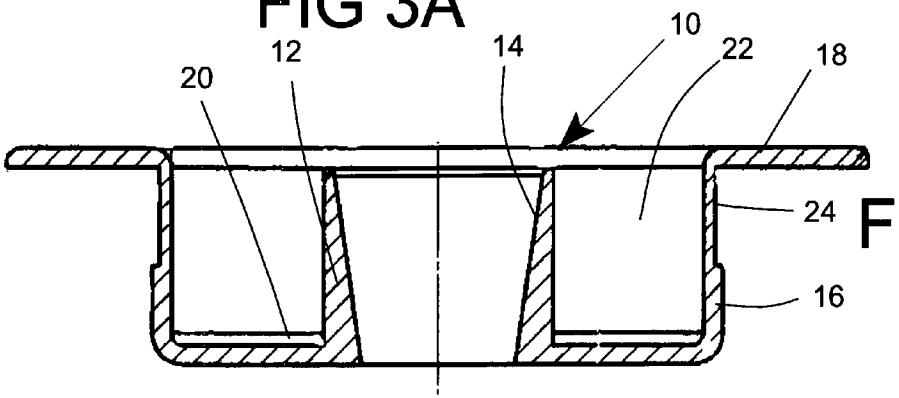

The one-piece molded outer member 10 is shown in FIGS. 3A-3C. This outer member is a drain unclogging device, and a drain unclogging device is discussed in U.S. Pat. No. 6,934,975, which is incorporated herein by reference. The one piece molded device 10 differs from that shown in U.S. Pat. No. 6,934,975, only as specifically described herein. For example, the groove 24 of the present device as shown in FIGS. 3A-3C is not present in the prior art device shown in U.S. Pat. No. 6,934,975. Outer member 10 can be used with a hand held spray nozzle as shown in the above identified patent. Outer member 10 has a generally circular base 20 with an annular hub or cylindrical projection 12 extending upwardly from the base upper surface. The base 20 can be large enough to fit over conventional kitchen sink drains or it can be sized to fit into a standard drain opening. A groove 24 is provided on the outside of cylindrical outer wall 16 so that a gasket 60 can be mounted on the exterior of the outer member 10. This gasket 60 will allow use of the unclogging member 10 for drains having different diameters. The upwardly projection annular hub 12 has an inner conical or tapered surface 14, which diverges in the upward direction, so that its upper open end has a larger diameter than its opening in the base 20. The cylindrical outer wall 16 of the outer or unclogging member 10 is spaced radially outwardly from the cylindrical projection or hub 12 and separated therefrom by a toroidal gap 22. An annular lip 18 is formed on the top of the outer wall 16. The height of the annular hub 12 can be greater than the height of the cylindrical outer wall 16, although that is not necessary. The outer wall 16 and the lip 18 can be sized so that unclogging member 10 can be inserted into a standard drain with the lip 18 preventing the adapter member 10 from falling into the drain. The lip 18 would also close the drain in that configuration. Alternatively the flat adapter base 20 can be positioned over the drain and held down to close the drain. The conical or tapered surface 14 is sized so that the head of a standard spray nozzle can be inserted into the top of the centrally projecting hub 12, but the opening at the top of the projecting hub is small enough so that the spray nozzle cannot be inserted completely through the central fluid passage formed by the interior of the projection 12. The conical surface 14 will also provide a reaction surface against which the spray nozzle can be downwardly pressed. This downward force will also hold the unclogging device 10 securely in or over the drain so that a stream of water can be sprayed into the drain to dislodge tightly impacted material in the drain. The outer unclogging member 10 will also serve to prevent the water spray or stream from backing up into the sink to enhance the effect of the stream injected into the drain. The stopper 50 can also be used in combination with the unclogger. Stopper 550 can be used to close a second opening in a conventional sink to create a closed loop system.

Figure 4B:
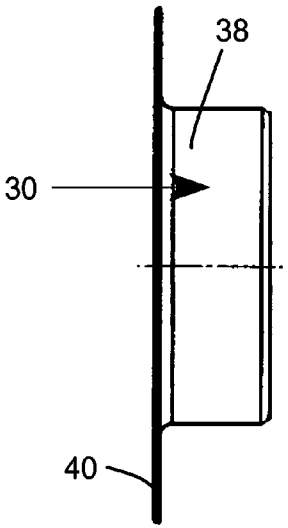
FIGS. 4A-4C are views showing the details of a basic strainer of the type employed in the embodiment of FIG. 1.
Figure 4A:
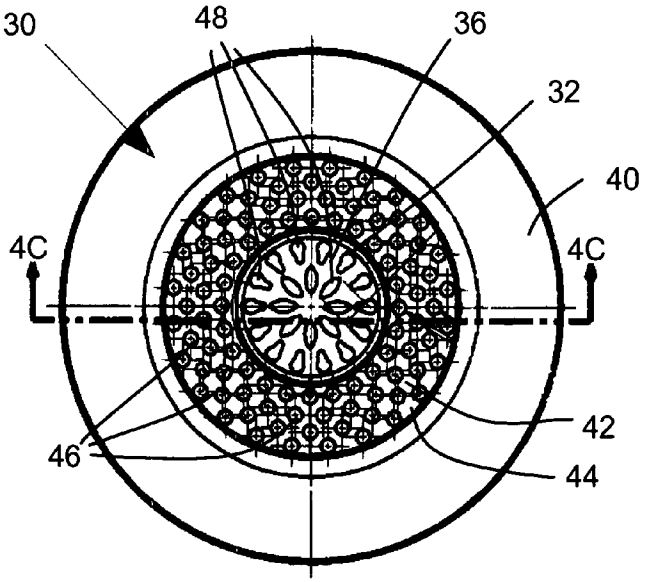
Figure 4C:
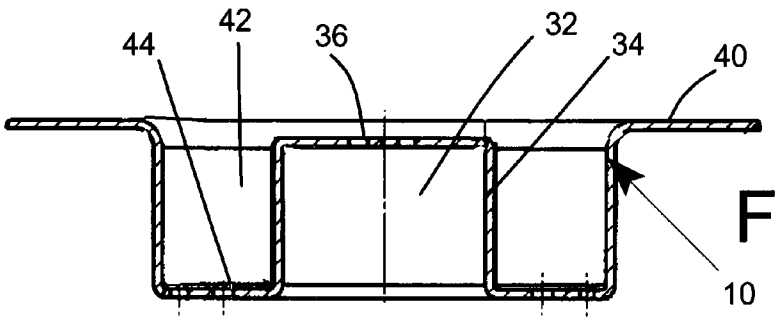

FIGS. 4A-4C show details of the strainer 30 employed in the kit embodiment of FIG. 1. Strainer 30 is normally fabricated as a one-piece injection molded member, and it can be fabricated from a straight pull mold to lower manufacturing cost. However, the strainer 30, and other components, can be fabricated using methods other than injection molding.

Strainer 30 comprises a cylindrical outer wall 34 spaced from a central hollow column 32. The column wall 32 and the outer wall 34 are concentric and are separated by a toroidal gap 42. Both the column wall 32 and the outer wall 34 extend upwardly from the perforated base 44 of the strainer 30. The perforated column top 36 is integral with the column wall 32. The column top section 36 is therefore in the shape of a circle or disk and an plurality of perforations 48 extend through the column top 36. The base 44 also includes a series of perforations 46. Perforations 46 and 48 are sized to permit relatively free flow of water and so that food and other debris that might clog or contribute to clogging a drain cannot enter a drain when the strainer 30 is in place. The annular peripheral lip 40 extending outward from and integral with the top of outer wall 38 is dimensioned to prevent the strainer 40 from falling into an oversized drain. Lip 40 also seals off the drain opening or the disposal to create a closed loop system and prevents water from splashing out. As shown in FIG. 4C, the peripheral lip 40 is elevated slightly above the column top section 36.

The strainer 30 is normally not intended to be used at the same time as the unclogging device 10. The strainer 30 can of course be used with the unclogging device 10, but the flow of water would be restricted to water passing thought perforations 48 in the top section 36 and through the hollow central projection 12 on the unclogging device 10. The strainer 30 is, however, stackable on top of the unclogging device 10. Thus the inner diameter of the column 32 will be greater than the outer diameter of the projecting hub 12 so that the strainer 30 can be stacked on top of or nested with the unclogging device 10 when packaged or stored.

Figure 5A:
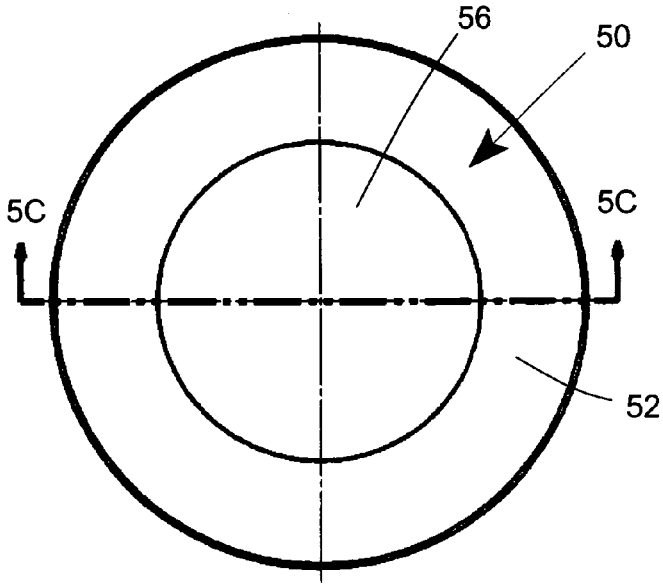
Figure 5B:
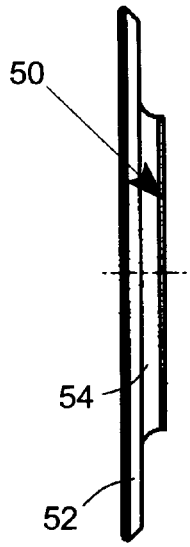
Figure 5C:
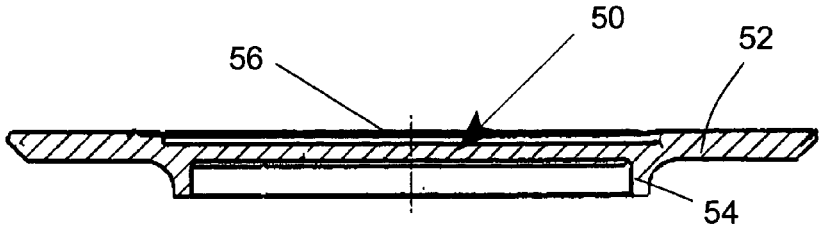

Details of the stopper 50 are shown in FIGS. 5A-5C. The main function of stopper 50 is to seal a sink drain. Stopper 50 is a molded member and is fabricated from a material that is more flexible and rubbery than the strainer 30 or the unclogging device 10, so that the stopper 50 will seal a drain over which it is placed. Stopper 50 includes an outer section 52 which will extend beyond a drain opening over which the stopper may be placed. A rim or ridge 54 on the bottom surface of the stopper is dimensioned to fit within a drain, and its radiused contour will aid in sealing the drain. This rim 54 will also fit within the top of the annular or toroidal gap 42 of the strainer when the stopper is packaged on top of the strainer 30 or the strainer 70. The stopper 50 is normally used alone, but it can be used with strainers 30 and 70 when positioned within a sink drain. When packaged as part of a kit the stopper 50 will form the top of the stack of components. Since the stopper 50 will be the most visible packaged component, a recess 56 in formed on the top surface of the stopper 50. As shown in FIG. 5D, a A disk 57 containing a emblem or logo can be inserted into this recess 56 so that it will be visible to the purchaser. The logo or emblem need not be a permanent part of the stopper 50 so that interchangeable logos or emblems can be mounted on the stopper 50 by different retailers or sellers. Of course the stopper can be manufactured so as to include a permanent emblem.

Figure 6A:
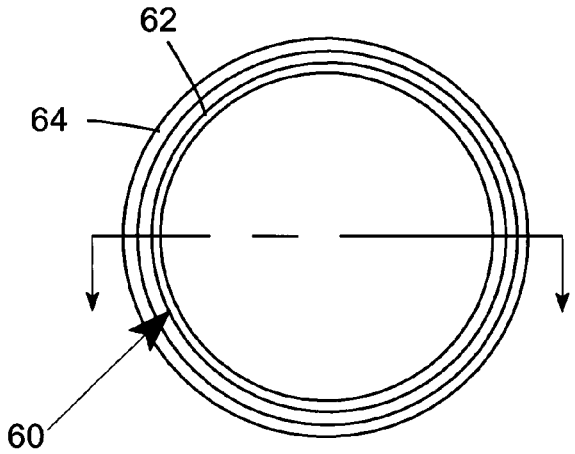
FIGS. 6A-6C are views of a gasket that can be used on the outer wall of the outer unclogging apparatus so that a wider variation of sink drains can be accommodated.
Figure 6B:
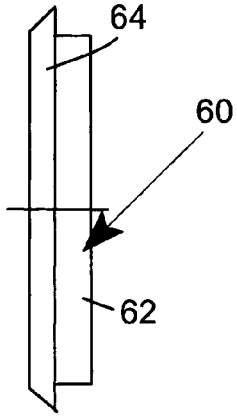
Figure 6C:
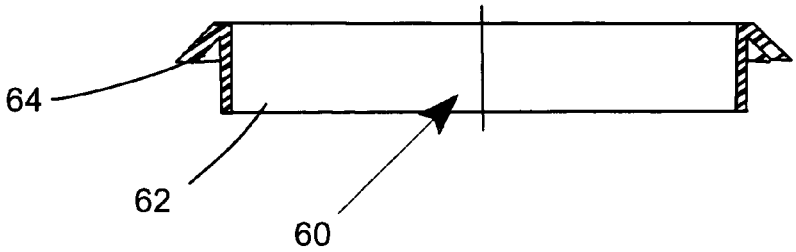

Although the kit 2 and the unclogging device is intended to be used with standard sink sizes, there is some variation in the diameter of sink drains. Therefore a gasket 60, shown in detail in FIGS. 6A-6C can be mounted within groove 24 on the outer wall 16 of unclogging device 10. Gasket 60 is fabricated from a flexible or rubbery material and includes a cylindrical gasket wall 62 with a reversely formed lip 64 extending from one edge thereof. This lip 64 permits insertion of the unclogging device into drain openings having a variation in diameters normally found in commercial available sink drains.

Figure 7B:
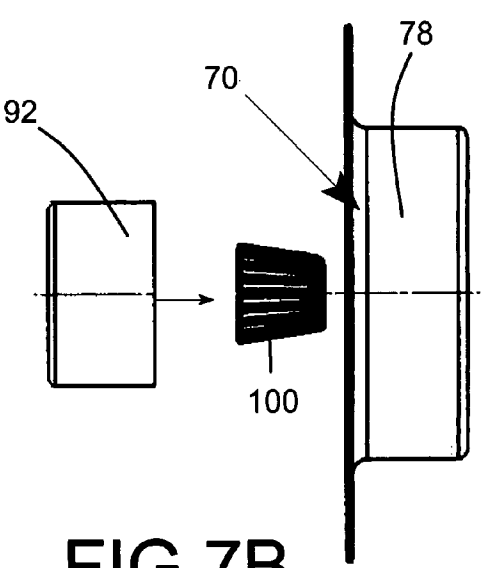
FIGS. 7A-7D are views of a strainer that would be used in the kit shown in FIG. 2 and would incorporate an air freshener.
Figure 7A:
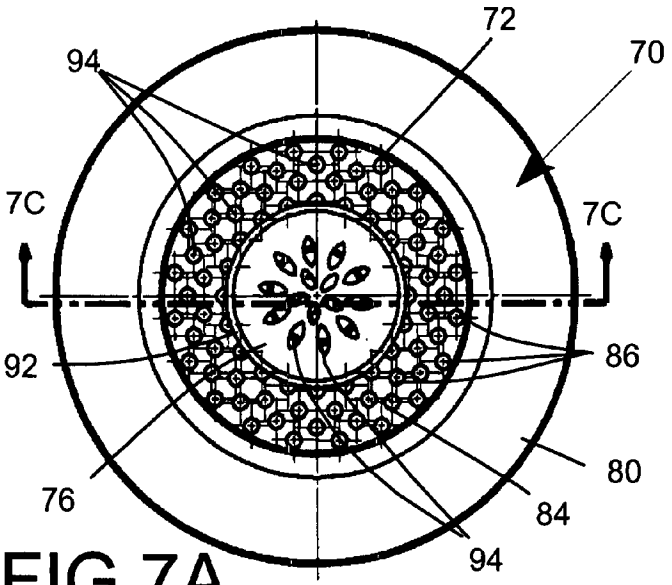
Figure 7C:
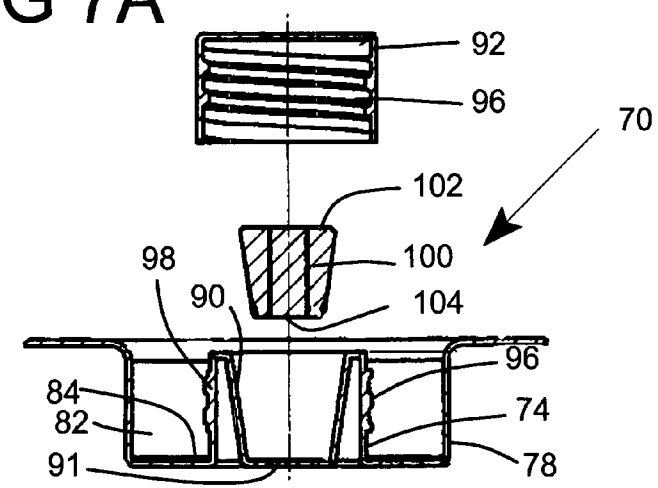
Figure 7D:
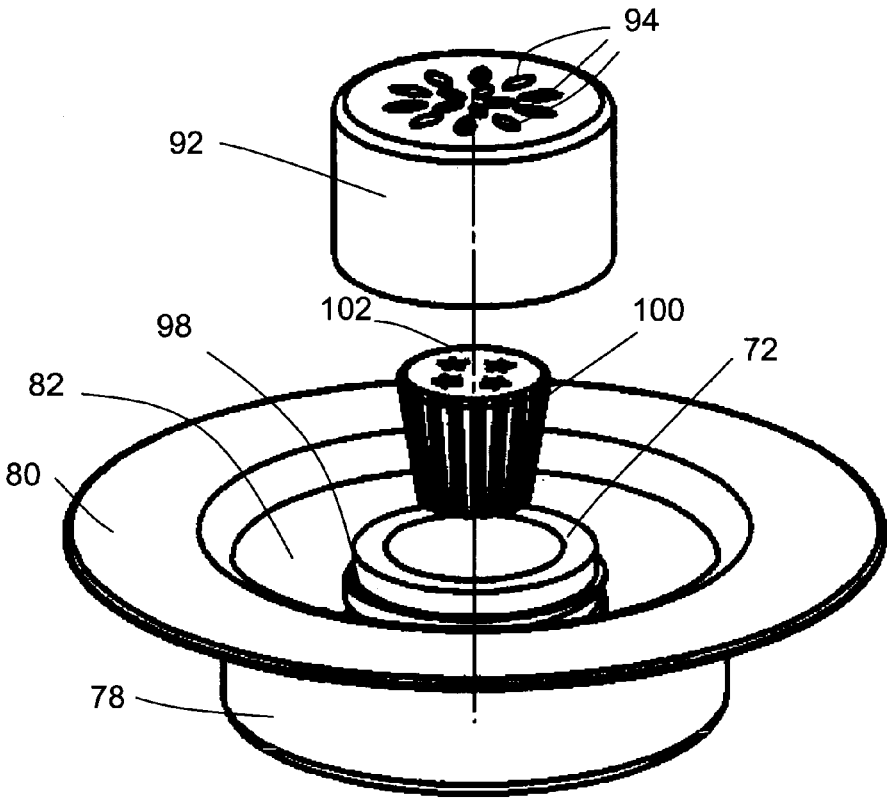

As previously mentioned, the kit 2 shown in FIG. 1 can be converted into a kit including an air freshener by replacing strainer 30 with strainer 70 and with the addition of an air freshening cartridge 100. This subassembly in shown in more detail in FIGS. 7A-7D. The primary difference between the strainer 70 and the strainer 30 is the replacement of the one-piece hollow central column 32 in strainer 30 with a two piece hollow central column 72 in strainer 70. A strainer cap 92 can be attached to and detached from the cylindrical wall 74. In this embodiment, the strainer cap 92 includes inner threads 96, which will engage outer threads 98 on wall 74. In addition to the cylindrical wall 74, strainer 70 also has a tapered or conical inner wall 90, which extends downwardly from the top edge of cylindrical wall 74. As shown in FIG. 7C, bottom edges of this tapered wall 90 are joined by a web 91 that includes perforations similar to perforations 86 in the base 84. Strainer cap 92 also includes a series of perforations 94 on its top surface. A small compartment is formed by tapered inner wall 90 the bottom web 91 and the strainer cap 92. Into this cap an air freshener cartridge 100 can be introduced. Air freshener cartridge 100 has a generally frusta-conical configuration with a flat upper surface 102 and slanting sides. The air freshener cartridge can be fabricated in a number of different ways and in a number o different shapes. First a liquid or granular active air freshener can be contained within a package have the shape of the cartridge 100 shown in FIG. 7D. Alternatively, a cartridge could be in the form of a cake of material formed into a shape that would be received within tapered walls 90. Alternatively, the bottom web 91 could be solid and a granular air freshener could be introduced into the interior cavity and the strainer cap 92 could be attached to the hollow column 72. Perforations 94 would then allow the fragrance to permeate to the surrounding area. The term freshener cartridge, should be understood to refer to each of these alternatives, and there are a number of alternative ways to introduce an air freshening material into strainer 70. other It would even be possible to introduce a liquid, provided perforations 94 would be small enough to prevent undue spillage. Importantly, however, all of these alternatives would permit the air freshening cartridge or its remnants to be removed when spent, and a new cartridge or material could be added when needed.

It should be understood that other alternative embodiments would be apparent to one of ordinary skill in the art. For instance, the air freshener could be replaced by a cleaner or an antibacterial agent. Thus chemical cartridges other than air freshening cartridges could be employed. The embodiments depicted herein are therefore only representative of various equivalent devices that would be readily apparent to one of ordinary skill in the art.

We claim:

1. A kit for treating a sink, the kit comprising:

an outer member including a central projection engageable with a spray nozzle for clearing a clogged drain;

a strainer packageable within the outer member, and being removable therefrom, the strainer including a perforated base and a hollow central column, the central projection on the outer member being received within the hollow central column when the strainer is packaged within the outer member; and a stopper packaged on top of the strainer; and wherein the outer member and the strainer both include peripheral lips with the strainer peripheral lip laying on top of the outer member peripheral lip when components of the kit are in a packaged configuration the stopper being engagable with the peripheral lip of the strainer or the peripheral lip of the outer member, when the strainer is removed to close the sink drain in which components of the kit are disposable.

2. The kit of claim 1 wherein a perforated strainer cap is mountable on the hollow central column.

3. The kit of claim 2 wherein a chemical cartridge is mounted within the hollow central column and secured therein by the perforated strainer cap.

4. The kit of claim 3 wherein the perforated strainer cap is removable from the hollow central column so that a spent chemical cartridge can be replaced.

5. The kit of claim 3 wherein the chemical cartridge comprises a conical member.

6. The kit of claim 1 including a gasket securable to the exterior of the outer member.

7. The kit of claim 1 wherein the strainer is nested within the outer member when packaged therein.

8. The kit of claim 1 wherein the stopper is removable from the kit, and comprises a sealing member positionable over a sink drain to close the drain.

9. The kit of claim 1 wherein the outer member, the strainer and the stopper comprise molded plastic members, the stopper being more flexible than the outer member and the strainer for comprising a drain stopper when placed over a drain.

10. A drain treatment cluster comprising a plurality of stackable components separately useable to maintain a sink drain in a flowing condition, the cluster comprising a cylindrical outer member, a cylindrical strainer, and a stopper:

the cylindrical outer member being for use in unclogging a stopped drain and including a central projection having a tapered inner surface extending upward from surrounding solid base, the tapered inner surface being engageable with a spray nozzle to concentrate injection of water from the spray nozzle into a stopped drain;

the cylindrical strainer having an annular base with a hollow central column extending upwardly therefrom, a top section of the hollow central column and the annular base each having a plurality of perforations for straining debris before entrance into a sink drain when the cylindrical strainer is positioned therein;

the stopper comprises a stopper that can be placed over a drain; and wherein a chemical cartridge is mountable within and to the hollow central column of the strainer so that the cylindrical outer member and the cylindrical strainer are stackable.

11. The drain treatment cluster of claim 10 wherein the stopper comprises a flexible member including a surface engagable with the strainer when the strainer is positioned within a sink drain and engageable with a sink drain when employed to close a sink in the absence of the strainer.

12. The drain treatment cluster of claim 10 wherein a cap is attachable to and detachable from a cylindrical wall on the hollow central column to retain the chemical cartridge within the hollow central column when attached thereto, the cap including perforations and comprising the top section of the central column when attached to the cylindrical wall of the hollow central column.

13. The drain treatment cluster of claim 12 wherein the chemical cartridge comprises an air freshener cartridge.

* * * * *